United States Patent [19]

Watanabe et al.

[11] 4,335,331

[45] Jun. 15, 1982

[54] LOW PRESSURE METAL VAPOR DISCHARGE LAMP

[75] Inventors: Yoshio Watanabe, Tokyo; Mikiya Yamane; Teruichi Tomura, both of Kunitachi, all of Japan

[73] Assignee: Hitachi, Ltd., Tokyo, Japan

[21] Appl. No.: 158,264

[22] Filed: Jun. 10, 1980

Related U.S. Application Data

[63] Continuation of Ser. No. 932,546, Aug. 10, 1978, abandoned.

[30] Foreign Application Priority Data

| | | | |
|---|---|---|---|
| Aug. 10, 1977 | [JP] | Japan | 52-95041 |
| Sep. 28, 1977 | [JP] | Japan | 52-115622 |
| Sep. 28, 1977 | [JP] | Japan | 52-115623 |
| Sep. 28, 1977 | [JP] | Japan | 52-115624 |

[51] Int. Cl.[3] ..... H05B 41/16

[52] U.S. Cl. ..... 315/334; 313/188; 313/204; 313/493; 315/205; 315/260

[58] Field of Search ..... 313/188, 190, 204, 205, 313/220, 493; 315/200 R, 205, 260, 266, 334, 337, DIG. 5

[56] References Cited

U.S. PATENT DOCUMENTS

| | | | |
|---|---|---|---|
| 3,609,436 | 9/1971 | Campbell | 313/204 |
| 3,849,689 | 11/1974 | Campbell | 313/190 |
| 4,142,125 | 2/1979 | Lauwerijssen et al. | 313/493 X |

*Primary Examiner*—Eugene R. LaRoche

*Attorney, Agent, or Firm*—Craig and Antonelli

[57] ABSTRACT

A low pressure metal vapor discharge lamp has a double-tube type discharge vessel consisting of a fully closed outer glass bulb and an inner glass tube substantially coaxially disposed in the outer glass bulb, the inner glass tube being closed at its fixed end and opened at its free end. The space within the discharge vessel is filled with a small amount of a metal and a rare gas of a low pressure. A single cathode is disposed within the space inside the inner glass tube, while a plurality of anodes are disposed in the annular space between the inner glass tube and the outer glass bulb. According to the invention, a number of discharge channels corresponding to that of the anodes are formed between the single cathode and respective anodes, via the opening end brim of the inner glass tube. In operation, anode oscillations take place alternately in respective anodes to cause a self-excitation switching operation, so that a plurality of plasmas are formed. Further, in order to avoid flickering of the output light of the lamp, which is attributable to the irregular fluctuation of the plasmas, means are provided for stably fixing the discharge channels to respective constant positions. The means for fixing the discharge channels may be in the form of axial notches formed in the opening end brim of the inner glass tube, corresponding to the anodes, or a partition plate disposed at the opening end of the inner glass tube and adapted to separate the discharge channels from each other.

18 Claims, 23 Drawing Figures

LOW PRESSURE METAL VAPOR DISCHARGE LAMP

This is a continuation of application Ser. No. 932,546 filed Aug. 10, 1978, now abandoned.

BACKGROUND OF THE INVENTION

1. FIELD OF THE INVENTION

The present invention relates to an improvement in low pressure metal vapor discharge lamps and, more particularly, to a single base fluorescent lamp the size of which is reduced by the use of a double-tube structure for the discharging vessel.

2. DESCRIPTION OF THE PRIOR ART

A conventional low pressure metal vapor discharge lamp, which is well represented by an ordinary lighting fluorescent lamp (low pressure mercury vapor discharge lamp), has an elongated glass tube provided at both ends with electrodes and accommodating a rare gas of several Torrs pressure and a small amount of a metal such as mercury. This type of lamp has a large length for its lighting power. For instance, the length of a straight-tube type fluorescent lamp provided at both sides with bases well reaches 120 cm for an electric input of 40 W.

This double base type fluorescent lamp having a large length is, in some cases, extremely inconvenient. Rather, this type of lamp is not recommended for some specific uses. This gives rise to a demand for a smaller fluorescent lamp having a reduced tube length while preserving good brightness.

To comply with this demand, Japanese Patent Publication No. 35796/1974 discloses a novel fluorescent lamp having only one base. The proposed fluorescent lamp has a double-tube structure consisting of a fully closed outer glass bulb and an inner glass tube disposed within the outer glass bulb, the inner glass tube being open at one end but closed at the other end. One (cathode) of the electrodes is disposed within the inner glass tube, while the other (anode) electrode is disposed outside the inner glass tube. According to this arrangement, the discharge path formed between two electrodes makes a turn at the opening end of the inner glass tube, so that a sufficiently large length of the discharge path can be obtained with a relatively small length of the lamp.

Further, the luminous efficiency is expectedly improved because the area of the glass tube surrounding the discharging space is increased to provide a larger area of the surface to which the luminous paint (phosphor material) is applied.

This known double-tube type of discharge lamp, however, has a problem in that it is difficult to uniformly distribute the discharge plasma over the entire discharging space between the inner glass tube and the outer glass bulb.

Namely, the discharge plasma outside the inner glass tube is concentrated locally to the region which exhibits the smallest resistance to the discharge current, and is not spread uniformly over the entire discharging space. This local concentration of the discharge plasma can never be avoided even by the use of a ring-shaped anode disposed around the inner glass tube. In such a lamp, the luminous intensity is specifically high only at the region to which the plama is locally concentrated, while only a low luminous intensity is obtained at portions of the lamp where the plasma is not distributed. Thus, it is difficult to obtain a uniform luminous intensity distribution over the entire lamp body.

In addition, in the double-tube type lamp of the kind described, the discharge plasma which is locally concentrated to a portion of the discharging space changes its position irregularly so as to cause the so-called "flickering phenomenon".

In order to overcome the problem concerning the local concentration of the plasma in the known double-tube type fluorescent lamp, the specification of U.S. Pat. No. 3,609,436 as well as the Journal of the Illuminating Engineering Society (Vol. 2, No. 2, October 1972, pages 3–7), proposes an improved lamp in which a plurality of anodes are disposed around the inner glass tube. These anodes are switched successively so as to forcibly rotate the locally concentrating plasma at a high speed around the inner glass tube to thereby achieve a uniform luminous intensity over the entirety of the lamp.

This improved lamp, however, requires a complicated and expensive transistor switching circuit for a high-speed switching of the voltage over the successive anodes and, therefore, is not practical from both technological and economical points of view.

SUMMARY OF THE INVENTION

It is, therefore, an object of the present invention to provide a practical and less expensive double-tube type low pressure metal vapor discharge lamp in which the local concentration of the discharge plasma and unstable behavior of the same are avoided to ensure a materially uniform and stable light output distribution over the entirety of the lamp, without necessitating the complicated and expensive switching circuit which is used in the above-mentioned existing lamp.

To this end, according to the present invention, there is provided a double-tube type low pressure metal vapor discharge lamp having a plurality of anodes disposed between the inner glass tube and the outer glass bulb, and a cathode disposed within the inner glass tube. Electric discharges are performed between the cathode and respective anodes, and a self-excited switching action is effected by anode oscillation alternately produced at the anodes, so that a plurality of lines of plasma are generated in the discharging space. The lamp of the invention is further provided with means for fixing the paths of discharge currents corresponding to respective plasma lines to constant positions, so as to prevent the positions of the plasma lines from fluctuating.

The plurality of plasma lines can be generated by applying substantially equal voltages in relation with the cathode to all anodes simultaneously. At the same time, any construction which exclusively defines the paths for respective discharge currents can be used as the above-mentioned means for fixing the paths of discharge currents. Thus, the means for fixing the discharge current paths may be constituted by notches formed in the opening end brim of the inner glass tube at portions of the latter corresponding to the anodes, or partition plates provided at the opening end of the inner glass tube so as to separate the adjacent discharge current paths. Thus, any type of means capable of defining, for each of the plasma lines, a stable current path through which the discharge current can flow is encountered by a resistance specifically smaller than through other parts of the area shared by each plasma line.

This arrangement affords a substantially uniform luminous intensity distribution over the entirety of the lamp because of the presence of a plurality of plasma lines corresponding to respective anodes and disposed around the inner glass tube. In addition, the flickering of the output light is conveniently avoided because the irregular fluctuation of the discharge plasmas is avoided.

The above and other objects, as well as advantageous features of the invention, will become more clear from the following description of the preferred embodiments taken in conjunction with the accompanying drawings.

DESCRIPTION OF THE PREFERRED EMBODIMENT

Figure 1:
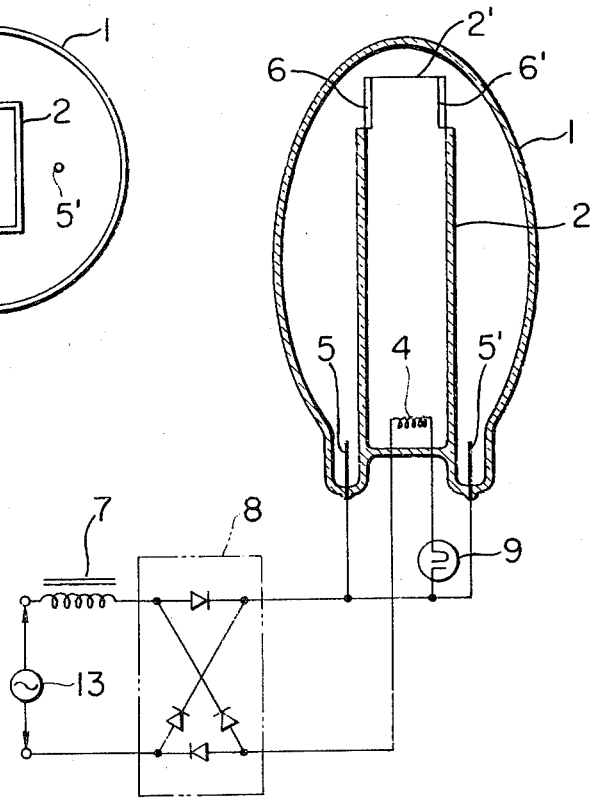
FIG. 1 is a schematic longitudinal sectional view of a low pressure metal vapor discharge lamp embodying the present invention, schematically showing the internal structure of the same, along with its ignition circuit.

Referring first to FIG. 1 schematically showing the construction of a low pressure metal vapor discharge lamp embodying the present invention, an elongated outer glass bulb, a tubular inner glass tube, and a stem are designated at reference numerals 1, 2, and 3, respectively. The outer glass bulb 1 is fusion-welded at its lower end portion to the stem 3, so as to constitute a completely closed discharge vessel, while the inner glass tube 2 is bonded or fusion-welded at its lower end to the stem 3, and is held at the center of the space within the outer glass bulb 1. The outer glass bulb and the inner glass tube are disposed coaxially with each other. The inner glass tube is opened at its upper end but is closed at its lower end by the stem 3.

A single cathode 4 (a filament electrode coated with an electron-emitting substance) is disposed within the inner glass tube 2, in the vicinity of the lower end of the latter. A plurality of anodes in the form of a plurality of separate rod-shaped electrodes are disposed at the lower part of a discharging space defined by the outer surface of the inner glass tube 2 and the inner surface of the outer glass bulb 1, i.e. at the portion of the discharging space closer to the closed end of the inner glass tube 2.

In the illustrated embodiment, two anodes 5, 5' are disposed so as to diametrically oppose each other, i.e. at positions symmetrical with respect to the axis of the inner glass tube 2. The inner peripheral surface of the outer glass bulb is coated with a film (not shown) of a fluorescent material. The opening end brim 2' of the inner glass tube 2 is notched at portions thereof axially aligned with anodes 5, 5' as at 6, 6'.

The space inside the discharge vessel 1 is evacuated through an exhaust tube (not shown) provided in the stem 3. Then, the space is charged with a rare gas of low pressure (e.g. argon gas at several Torr) and a small amount of metal, such as mercury. Finally, the space is sealed at the end of the exhaust tube.

A single base (not shown) is attached to the lower end portion, i.e. to the stem portion, of the double-tube type discharge lamp having the described construction. Thus, the lamp is used as a single-base type discharge lamp. This lamp is connected to an A.C. source 13 through an ignition circuit including a ballast inductor 7, a diode bridge rectifier circuit 8, and glow lamp 9, so as to be energized and ignited by the A.C. power. This ignition circuit may be provided separately from the lamp body, or may be incorporated in the base attached to the discharge lamp.

In operation, as the lamp is connected to the A.C. source 13 through the ignition circuit, the A.C. voltage is rectified by the diode bridge rectifier circuit 8, the output from which ignites the glow lamp 9. As the contact is made in the glow lamp 9, preheating current is allowed to flow through the cathode 4. As the contact is broken in the glow lamp 9 while the cathode 4 has been sufficiently heated, a high pulse voltage is applied between the anodes 5, 5' and the cathode 4 at the instant at which the contact is broken, so as to cause electric discharges between the cathode 4 and respective anodes 5, 5', thus placing the lamp into operation.

The inner glass tube 2 is disposed at the center of the outer glass bulb coaxially with the latter, and the two anodes 5, 5' are disposed in symmetry with respect to the axis of the inner glass tube 2, in the same mounting condition. In addition, since the anodes 5, 5' are electrically shorted, the levels of voltages applied to both anodes by the rectifier circuit 8 in the ignited condition are equal to each other. In this condition, anode oscillations take place alternately at the anodes, so that the discharge takes place alternately at both anodes 5, 5' as described below. Two channels for the discharge current are formed, one of which corresponds to the anode 5 while the other corresponds to the anode 5'. Thus, one of the discharge currents flows through a channel formed between the anode 5 and the cathode 4, via the axial notch 6 formed in the opening end brim of the inner glass tube 2, while the other discharge current flows through the other channel formed between the anode 5' and the cathode 4 via the other axial notch 6' formed also in the opening end brim of the inner glass tube 2. These two discharge currents flow alternately during a short switching period, by a self-excitation switching caused by the anode oscillation alternately taking place in the anodes 5, 5'.

The anodes 5 and 5' are directly connected with each other. That is, the anodes 5 and 5' are electrically shorted. Thus, in the operation, the same voltage is applied to both anodes. Now, let us suppose that in one of the discharge channels (for example, the discharge channel between the anode 5 and the cathode 4, via the axial notch 6), excessions are produced in the front space of the anode 5. In this state, the plasma impedance of this discharge channel is lower than that of the other discharge channel, hence almost all of the discharge current flows through the former discharge channel. But, at the same time, a small amount of the discharge current is flowing through the latter discharge channel owing to the charged particle diffusion from the former discharge channel to the latter. Therefore, the formation of the space charge is occurring in front of the anode 5'.

The excessions in front of the anode 5 are extinguished with time owing to the diffusion or the transition etc. Then, the space charge is formed again, and the voltage of the anode 5 is raised. Since the anode 5' is electrically shorted with the anode 5, the voltage of the anode 5' is also raised. Consequently, the discharge current of the latter discharge channel increases. The amount of the space charge in front of the anode 5' is rapidly increased, and an explosive ionization occurs in front of the anode 5=, and thus excessions are formed. Then, the plasma impedance of the latter discharge channel rapidly lowers, and thus almost all of the discharge current flows through the latter discharge channel. Thereafter, the same operation is repeated.

The above-mentioned phenomenon including the formation of the space charge and the explosive ionization is called "anode oscillation". In the discharge lamp shown in FIG. 1, a high frequency discharge current of the order of several k Hz flows with the help of the anode oscillation. Therefore, the discharge lamp shown in FIG. 1 shows a kind of self-switching operation. Accordingly, the discharge current flowing in both discharge channels are equalized with each other in effective values.

Figure 4A:
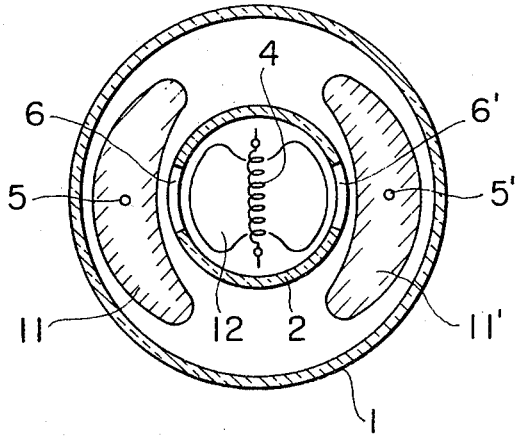
FIGS. 4A and 4B are illustrations of operation of the lamp as shown in FIG. 1.
Figure 4B:
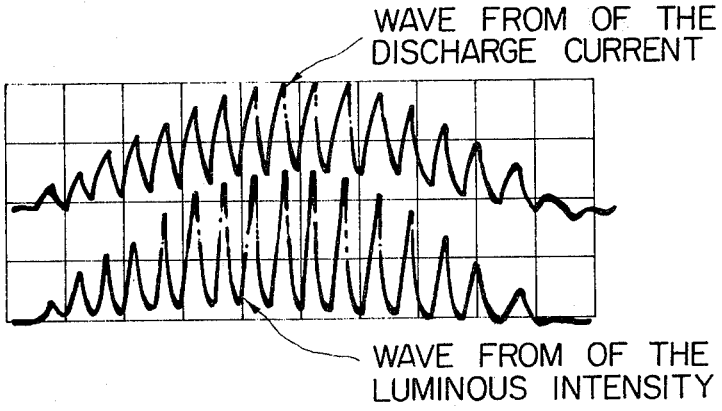

FIGS. 4A and 4B illustrate the operation of the low pressure metal vapor discharge lamp in accordance with the present invention. More specifically, FIG. 4A is a schematic illustration corresponding to a cross-sectional view of the embodiment as shown in FIG. 1 at a plane including the notches 6, 6', while FIG. 4B shows the waveforms of the discharge currents and luminous intensity. As will be seen from FIG. 4A, the notches 6, 6', are located at positions corresponding to the anodes 5, 5', respectively. Thus, the discharge current from one of the anodes 5 to the cathode 4 flows through the notch 6, while the discharge current from the other of the anodes 5' to the cathode 4 is made to flow through the notch 6'. These two discharge currents cause two plasmas 11, 11' generated at the outside of the inner glass tube. The waveforms of the current of the plasma 11 and the luminescence over a half cycle are shown in FIG. 4B. The current is switched at a frequency of 1.5KHz and is the luminous intensity. The waveforms of the current of the plasma 11' and the luminosity are similar to those of FIG. 4B but are in inverted relation to the latter. Two plasmas are made substantially unitary with each other within the inner glass tube 2 as at 12. At the same time, the plasmas 11, 11' at the outside of the inner glass tubes are spread considerably laterally.

It is thus possible to spread the plasma over almost the entire region of the discharging space outside the inner glass tube by alternately forming two plasmas at a short switching period by the self-excitation switching. It is true that there are some areas outside the inner glass tube which are not filled with the plasma. However, this does not matter because ultraviolet rays radiated from the plasmas 11, 11' in all directions are applied uniformly to the entire area of the fluorescent coatings (not shown) on both the faces of the inner glass tube 2 and on the inner surface of the outer glass bulb 1 so that visible rays are radiated materially uniformly from all portions of the fluorescent coatings.

Turning again to a conventional lamp having only one anode, only a small part of the discharging space outside the inner glass tube is filled with the plasma because only one plasma is stably formed. Even if the single anode is in the form of a ring surrounding the inner glass tube, discharge current is inconveniently concentrated only to a limited portion of the ring-shaped anode and is never spread uniformly. In other words, in order to form a plurality of plasmas as in the present invention, it is essential to provide a plurality of anodes and to make a self-excitation switching by a regular anode oscillation. This can be performed simply by simultaneously applying substantially equal voltages to all anodes to keep them at substantially equal potentials over the cathode high enough to maintain the electric discharge.

In the embodiment shown in FIG. 1, the notches 6, 6' formed in the opening end brim 2' of the inner glass tube 2 function to fix the channel of each discharge current at a constant position on the circumference of the opening end brim 2' of the inner glass tube 2, to thereby stabilize the position at which each plasma is formed. Namely, provided that there is no notch 6, 6' in the opening brim 2', the discharge current does not always select the same discharge channel but rather fluctuates over a selected region irregularly. Consequently, the position of each plasma is irregularly changed to cause a flickering of the output light from the lamp.

In sharp contrast to the above, when the above-described notches 6, 6' are provided, the discharge channels passing these notches 6, 6' are much smaller than other discharge channels passing over the other portions of the opening end brim 2' of the inner tube 2 so that the discharge currents always flow through corresponding notches, so as to stabilize the positions of the plasmas to thereby avoid undesirable flickering of the output light.

Figure 2:
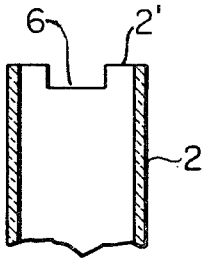
FIGS. 2 and 3 are longitudinal sectional views of end portions of different inner glass tubes incorporated in the lamp as shown in FIG. 1, showing, by way of example, different forms of notches formed in the tube end.
Figure 3:
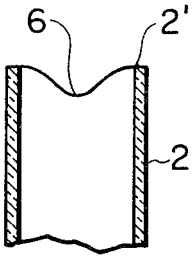

The notches 6, 6' can have any desired shape. For instance, each of the notches 6, 6' can have a rectangular shape as illustrated in FIG. 2, a valley-like shape having gentle slopes as shown in FIG. 3, or even a V-shape. At the same time, the breadth and depth of the notches can be selected as desired. All that is required is to fix the channels of respective discharge currents formed by a plurality of anodes.

The principal dimensions of the lamp of the embodiment as shown in FIG. 1 may be, by way of example, as follows:

(a) maximum diameter of outer glass bulb 1: 90 mm
(b) outer diameter of top of outer glass bulb: 47 mm
(c) outer diameter of base of outer glass bulb: 57 mm
(d) outer diameter of inner glass tube 2: 32 mm
(e) clearance between ends of anodes and end of inner glass tube: about 150 mm
(f) number of anodes and notches: 2 each
(g) distance between inside of outer glass bulb and end of inner glass tube: 5 to 30 mm
(h) maximum distance between inside of outer glass tube and notched part of inner tube: 10 to 30 mm
(i) breadth of notch (arcuate length): 10 to 25 mm
(j) substance filling the discharge space: mercury and argon gas of 1.5 to 3.0 Torr.

A discharge lamp having the above-stated particulars was experimentally manufactured. The luminous condition of the lamp, ignited by commercially available A.C. 100V power through the ignition circuit as shown in FIG. 1, was observed. It has been confirmed that the plasmas are made materially unitary with each other within the inner glass tube 2. These unitary plasmas are stabilized by the wall of the inner glass tube 2. Two plasmas are separated from each other as they clear the opening end of the inner glass tube 2 and lead to respective anodes.

In each anode, an anode oscillation of a frequency of 1 to several KHz was observed. At the same time, it was confirmed that the anode oscillations of both anodes take place alternately so as to switch the electric discharge from one to the other and vice versa.

Since the discharging space outside the inner glass tube 2 is ample, two plasmas are sufficiently diffused and spread laterally so that almost the entirety of the discharging space is filled uniformly with the plasma. It is considered that two plasmas are stabilized by the walls of the inner glass tube and the outer glass bulb, also in this discharging space.

It was found that it is essential to diminish the area of the surface of each anode exposed to the discharging space in order that the discharge plasma may be held stably at the area in the vicinity of the anode. Also, two plasmas were obtained relatively stably, even when there are no notches 6, 6' in the opening end brim 2' of the inner glass tube 2, provided that the respective parts of the lamp are arranged in correct symmetry with respect to the axis of the lamp. The demand for symmetry, however, is not so strict when the notches are formed in the opening end brim of the inner glass tube, still maintaining a stable shunting of the plasma.

Figure 5A:
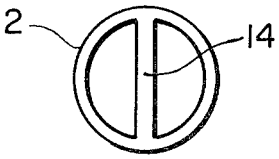
FIGS. 5A and 5B are a plan view and a sectional view of a modification of the embodiment as shown in FIG. 1 showing specifically an example of a partition plate provided at the opening end of the inner glass tube.
Figure 5B:
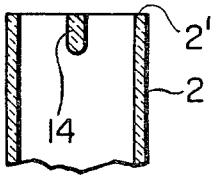

In the described embodiment, the means for stabilizing plasmas through fixing the channels of respective discharge currents are constituted by notches formed in the end of the inner glass tube. These means may, however, be constituted by other constructions. For instance, these means may be constituted by a partition plate secured to the opening end of the inner glass tube 2 and adapted to isolate the separated discharge plasmas from one another. An example of this arrangement is shown in FIGS. 5A and 5B. It will be seen that a partition plate 14 is provided at the center of the opening of the opening end of inner glass tube 2. This partition plate extends at a right angle to the line interconnecting the anodes 5, 5'.

According to this arrangement, the two plasmas are forcibly separated from each other by the partition plate 14 which clears the opening end of the inner glass tube. In addition, these plasmas are prevented from changing their positions, due to the presence of the partition plate and, therefore, are held in quite a stable manner.

Figure 6:
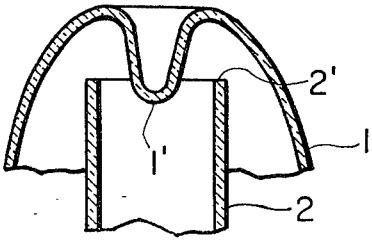
FIG. 6 is a longitudinal sectional view of a part of still another modification.

FIG. 6 shows another example of the partition wall provided at the opening end of the inner glass tube. Namely, the glass wall at the top of the outer glass tube 1 is projected inwardly in a plate-like form toward the opening end of the inner glass tube 2. This plate-like projection 1' extends in a direction perpendicular to the plane of the drawing so as to isolate the plasmas from one another. It will be seen that this arrangement offers the same advantage as that obtained by the foregoing example. Needless to say, it is possible to use the notches 6, 6' in combination with the partition plate 14 or the plate-like projection 1'.

Figure 7A:
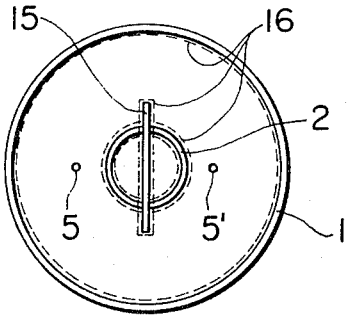
FIGS. 7A, 7B, and 7C are a schematic cross-sectional view, a schematic longitudinal sectional view, and a schematic side elevational sectional view, respectively, of a low pressure metal vapor discharge lamp which is another embodiment of the present invention.
Figure 7B:
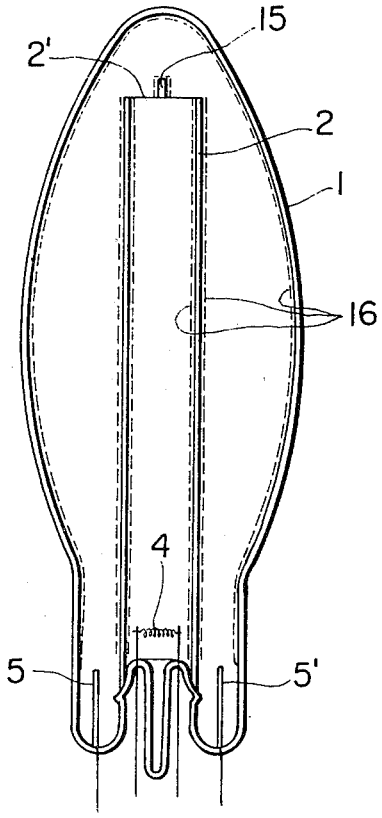
Figure 7C:
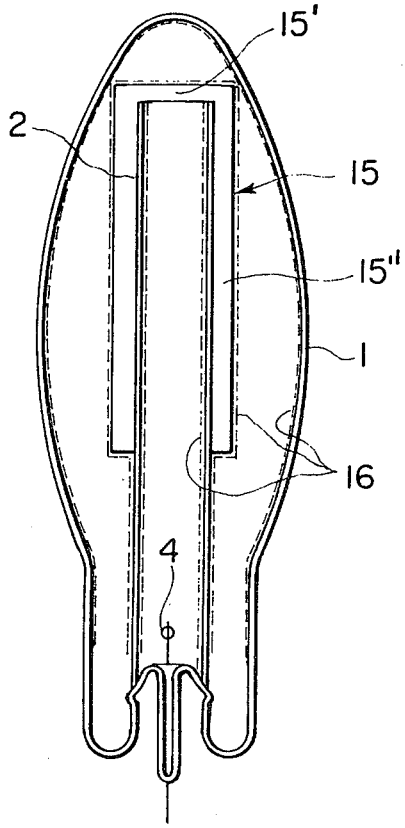

FIGS. 7A, 7B and 7C schematically show the construction of a low pressure metal vapor discharge lamp of another embodiment of the present invention. In these Figures, the same parts and members as those of the embodiment shown in FIG. 1 are denoted by the same reference numerals. In this embodiment, an elongated fin-shaped partition plate 15 is fixed to the inner glass tube, so as to extend in the longitudinal direction over the end and intermediate portions of the inner glass tube 2 instead of the notches 6, 6' or the partition plate provided at the opening end of the inner tube. This fin-shaped partition plate 15 consists of two portions 15', 15''. The portion 15' divides the discharging space around the opening end 2' of the inner glass tube 2, while the other portion 15'' divides the discharging space around the periphery of the inner glass tube 2. This partition plate 15 extends in the diametrical direction at a right angle to the line interconnecting the anodes 5, 5' within a plane which contains the axis of the inner glass tube 2.

Both surfaces of the inner glass tube 2, the inner surface of the outer glass bulb 1, and the surface of the partition plate 15 are coated with fluorescent films 16. The ignition circuit for this lamp may be constituted similarly to that of FIG. 1 or FIG. 14.

In operation, two plasmas are formed in the discharging space around the inner glass tube 2 by two discharge currents flowing through the channels between respective anodes 5, 5' and a common cathode 4. The two plasmas are stabilized by the partition wall 15 attached to the inner glass tube 2. More specifically, the plasmas which are unitary with each other while they are in the inner glass tube 2 are separated from each other as they pass over the opening end brim 2' of the latter. The separated plasmas are stabilized in the area around the opening end of the inner glass tube 2 because they are completely isolated from each other by the upper portion 15' of the partition wall 15. Thus, no irregular fluctuation of the plasmas around the opening end brim 2' of the inner glass tube 2 takes place. At the same time, the winding, snaking, and irregular shifting of the plasmas is fairly avoided also in the regions between the opening end brim 2' and respective anodes because they are stabilized by the walls of the portion 15'' of the partition plate 15.

Thus, according to this embodiment, discharge plasmas are generated and maintained stably over the whole length of the lamp due to the provision of the partition wall 15 which extends not only through the area around the opening end brim 2' of the inner glass tube but also axially along the length of the latter.

The principal dimensions of the lamp of this embodiment are, by way of example, shown as follows:

(a) length of outer glass bulb 1: 200 mm
(b) maximum diameter of outer glass bulb: 80 mm
(c) outer diameter of inner glass tube 2: 32 mm
(d) inner diameter of inner glass tube: 30 mm
(e) length of inner glass tube: 170 mm
(f) breadth of portion 15' of partition plate: 10 mm
(g) thickness of partition plate 15: 1 mm.

In the operation of the lamp of this embodiment the two plasmas are not always spread over the entire volume of the discharging space. However, the channels of the two discharge currents are fixed to constant portions of the discharging space so that the resulting two plasmas are held extremely stably, and are regularly switched by the anode oscillations. The ultraviolet rays radiated from both plasmas are converted into visible rays by the fluorescent films 16 formed within the lamp. These visible rays are scattered and reflected repeatedly within the lamp so that a materially uniform luminous intensity distribution is obtained over the entire surface of the lamp. It will be understood that the partition plate contributes not only to stabilize the channels of the discharging currents over almost the entire length of the lamp but also to increase the area of the wall surfaces in the lamp, i.e. the area of the fluorescent films, to thereby improve the luminous efficiency.

Figure 8A:
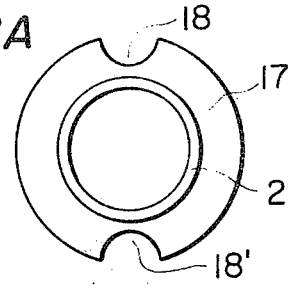
FIGS. 8A and 8B are a plan view and a longitudinal sectional view, respectively, of a part of the lamp in accordance with the invention, specifically showing another example of a partition plate provided on the outer surface of the inner glass tube.
Figure 8B:
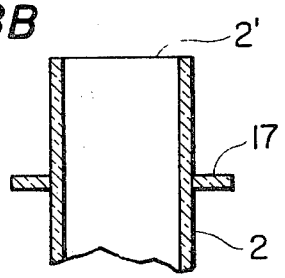

FIGS. 8A and 8B show another form of the construction for stabilizing the discharging plasmas at the outside of the inner glass tube 2. This construction has a flange-like partition plate 17 secured to the side of the inner glass tube 2. This flange-like partition plate 17 is provided with peripheral notches 18, 18' and is secured to the inner glass tube 2 such that its major surface forms a right angle to the axis of the latter. The aforementioned two notches are formed diametrically opposing each other, i.e. in symmetry with respect to the axis of the inner glass tube 2, such that each notch 18, 18' corresponds to each anode 5, 5' provided in the lamp.

It will be understood by those skilled in the art, in view of the foregoing description, that the discharge currents flowing from the opening end brim 2' of the inner glass tube 2 to the anodes 5, 5' are made to pass respective notches 18, 18' so that the channels of the discharge currents are fixed so as to stabilize the discharge plasmas. The flange-like partition 17 may be made single or in plural at a suitable axial pitch. Also, it is possible to use this flange-like partition plate 17 in combination with a longitudinal partition plate as shown in FIG. 7C. Further, these partition plates 15 and 17 may be used in combination with the notches 6, 6' as shown in FIG. 1.

Figure 9A:
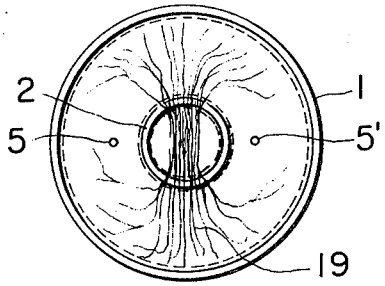
FIGS. 9A, 9B, and 9C are a schematic cross-sectional view, longitudinal sectional view, and a side elevational sectional view, respectively, of a low pressure metal vapor discharge lamp of still another embodiment of the present invention.
Figure 9B:
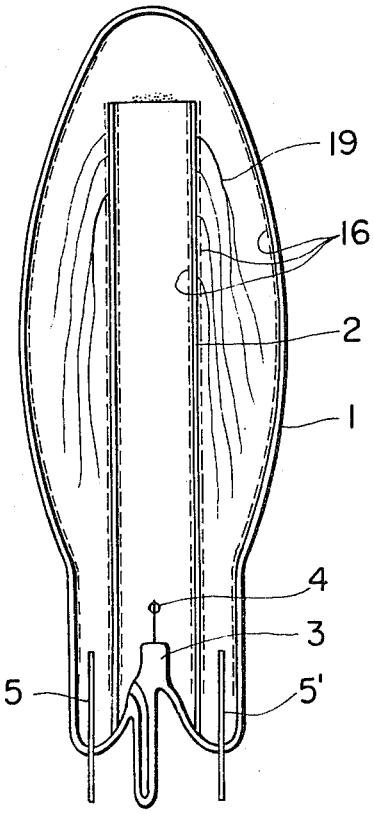
Figure 9C:
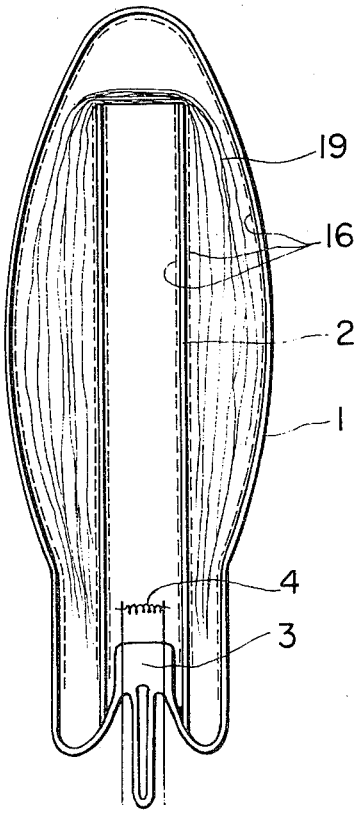

FIGS. 9A, 9B and 9C schematically show still another embodiment of the present invention. In this embodiment, solid fillers 19, such as glass fiber or glass wool, are provided around the inner glass tube 2 in place of the longitudinally extending partition plate secured to the outer surface of the inner glass tube 2 so as to fix the channels of the discharge currents, to thereby stabilize the discharge plasmas. More specifically, the portions of the discharging space which divide the entire discharge space into two sections corresponding to two anodes 5, 5' are filled with solid fillers 19, such as glass wool, at a high density, whereas the space corresponding to the anodes 5, 5' are not filled with the fillers 19 or are charged with the fillers only at a small density. The fillers 19 are bundled to have a high density at the area around the opening end brim 2' of the inner glass tube 2. This bundle extends across the end opening of the inner glass tube 2' at a right angle to the line intersecting the anodes 5, 5'. The fillers 19 are secured to and suspended from the opening end portion of the inner glass tube 2.

Figure 14:
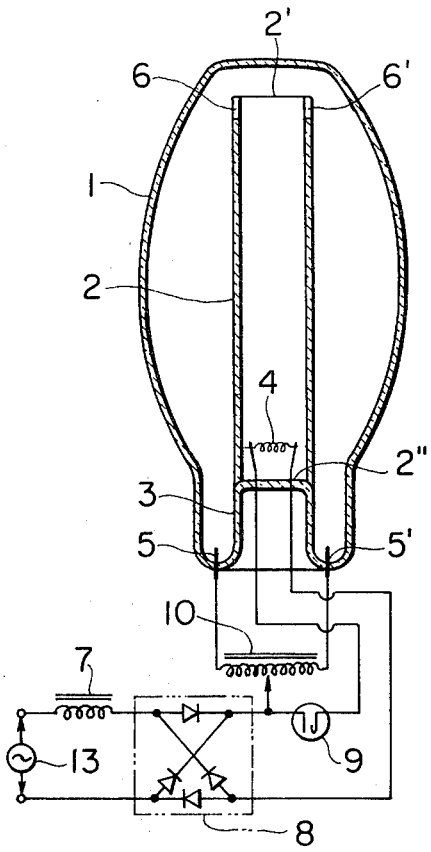
FIG. 14 is a schematic illustration of an example of the modification of the ignition circuit for the low pressure metal vapor discharge lamp in accordance with the present invention.

The inner surface of the outer glass bulb 1 and both surfaces of the inner glass tube 2 are coated with fluorescent films 16 while the space inside the discharge vessel is evacuated and filled with mercury and a rare gas of a pressure of several Torrs. This lamp can be ignited also by the ignition circuit as shown in FIG. 1 or FIG. 14.

In operation, two dischrge currents are generated between the cathode 4 and respective anodes 5, 5' and two plasmas are formed at the outside of the inner glass tube 2. These two plasmas are subjected to a self-excitation switching action caused by the anode oscillations alternately taking place in the anodes 5, 5'. Since the channels of the discharge currents are fixed by the presence of the solid fillers 19, these plasmas are generated and maintained in quite a stable manner. This is because the discharge currents detour the regions where the density of the fillers is relatively high, i.e. having higher resistance, and flows only through the regions where no filler is provided or charged with fillers only at a small density, i.e. only through the regions where the resistance is relatively small.

By way of example, it is suggested that the density of the fillers of the region of higher density is preferably $10^{-4}$ to $10^{-3}$ (volume ratio) while the density at the region of low density is several to several tenths of that of the higher density.

These fillers 19 may be coated with the fluorescent paint so as to increase the efficiency of conversion from the ultraviolet rays, which are radiated from the plasmas, into visible rays.

These fillers are effective not only in forming stable channels of the discharge currents but in increasing the loss of charged particles in the plasmas to thereby enhance the lamp voltage. It is, therefore, possible to maintain the lamp voltage at a considerably high voltage even when the size of the lamp is small. Thus, this embodiment can effectively be used as a light source for general illumination, making use of the commercially available 100 V A.C. power.

The glass wool constituting the fillers 19 may be substituted by fine glass tubes having much greater diameters than the glass wool or by insulating material other than the glass, ensuring the same advantageous effect. Needless to say, the term "region of small density of fillers" is used to mean not only a region having smaller density of fillers, but a region where no filler is provided as well.

Figure 10A:
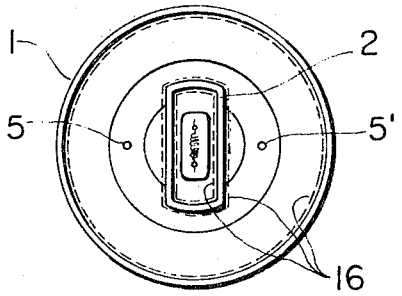
FIGS. 10A, 10B, and 10C are a schematic cross-sectional view, a schematic longitudinal sectional view, and a schematic side elevational sectional view, respectively, of a low pressure metal vapor discharge lamp of still a further embodiment of the present invention.
Figure 10B:
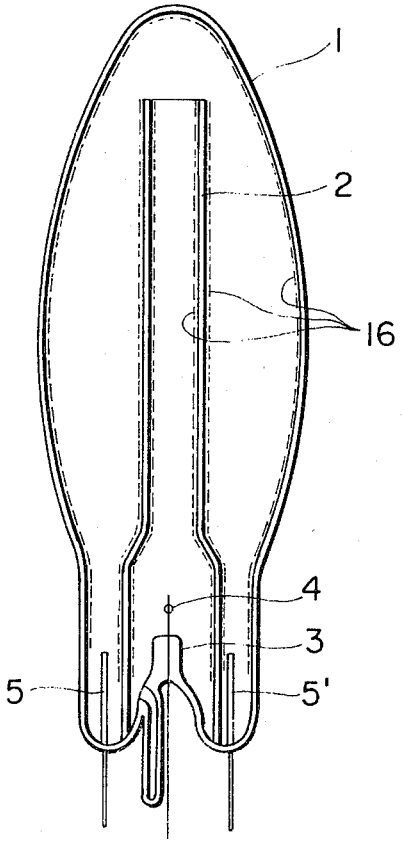
Figure 10C:
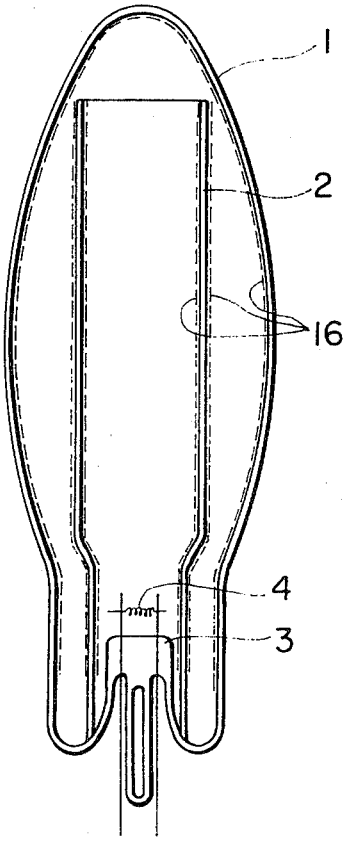

FIGS. 10A, 10B, and 10C show a further embodiment of the present invention in which, in order to stabilize the discharge plasmas, the inner glass tube 2 is made to have a flattened cross-sectional shape.

More specifically, the inner glass tube is flattened such that its longer sides extend in the direction perpendicular to the line interconnecting the anodes 5, 5'. Consequently, the discharging space around the inner glass tube 2 is made larger at the areas where the anodes 5, 5' are provided, and smaller at areas between the anodes 5, 5'. Consequently, the discharge currents are made to flow through the enlarged areas of the discharging space where the resistance is relatively small, detouring the narrowed areas where the resistance is relatively high. The channels of discharge currents are thus fixed to allow a stable generating and maintenance of the plasmas.

The principal dimensions of this embodiment are shown, by way of example, as follows:

(a) length of outer glass bulb 1: 200 mm
(b) maximum outer diameter of outer glass bulb: 80 mm
(c) length of longer side of flattened inner glass tube: 40 mm
(d) length of shorter side of flattened inner glass tube: 15 mm
(e) overall length of inner glass tube: 170 mm.

It has been well known that a high efficiency is obtainable by adopting a non-circular cross-section of glass tube in a straight-tube type large output fluorescent lamp. The lamp of this embodiment can be considered as materially being a large output lamp because it is a small-sized double-tube type lamp having a high lamp temperature and high pressure of mercury vapor.

The flattened shape of the inner glass tube offers an additional advantage of high efficiency of conversion of ultraviolet rays to visible rays and, accordingly, provides a higher lamp efficiency.

In addition, the flattened shape of the inner glass tube does not pose a problem in practical use as a general lighting source because it does not cause any change of the external appearance and design of the lamp.

Figure 11:
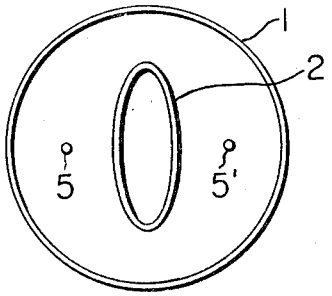
FIGS. 11, 12, and 13 are cross-sectional views of different modifications of the lamp in accordance with the present invention.
Figure 12:
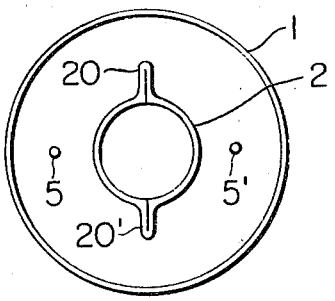
Figure 13:
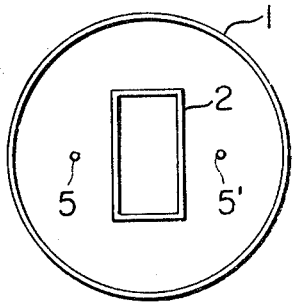

Rather than flatten the inner glass tube 2 at its sides corresponding to the anodes 5, 5', it is possible to form the inner glass tube 2 in an oval shape as shown in FIG. 11. At the same time, it is possible and effective to form fins 20, 20' at the sides of the inner glass tube 2, as shown in FIG. 12. Further, the same advantage can be brought about by an inner glass tube 2 having a rectangular cross-section as shown in FIG. 13.

FIG. 14 shows an example of the modification of the ignition circuit for the low pressure metal vapor discharge lamp in accordance with the present invention. The lamp shown in FIG. 14 has the same construction with the lamp of FIG. 1. But, the ignition circuit of the FIG. 14 differs from that of FIG. 1. That is, in FIG. 14, a discharge current shunting device 10 is provided. The shunting device 10 may be constituted by a current balancer of an autotransformer-type construction. The coil of the shunting device 10 is connected between the anodes 5 and 5', and the middle point of the coil is connected to the plus output terminal of the rectifier circuit 8. Thereby, the shunting device 10 has no impedance only when the discharge currents flowing in both discharge channels are equal to each other. Accordingly, both discharge currents are equalized with the help of the shunting device 10.

The use of the shunting device 10 is effective particularly when the self-switching operation due to the anode oscillation does not occur sufficiently.

As the shunting device, it is not necessary to use only the autotransformer-type construction. For instance, the shunting device may be constituted by an impedance element such as a resistor connected between the anodes 5, 5' with its middle point connected to the positive output terminal of the rectifier circuit 8.

Although the invention has been described with reference to specific embodiments in which two discharge plasmas are formed by the provision of two anodes in the lamp, it is possible, needless to say, to provide three anodes or more and make these anodes maintain their plasmas alternately at a short period by applying substantially equal voltage simultaneously to these anodes, so as to cause alternating anode oscillations. In such a case, the number of means for fixing the discharge channels such as notches, partition plates, or masses of fillers are selected to correspond to the number of the anodes.

As has been described above, according to the invention there is provided a low pressure metal vapor discharge lamp of the double-tube type having a plurality of equi-spaced anodes disposed around the inner glass tube. Regular anode oscillations are alternately generated in these anodes to cause self-excitation switching action so as to form a plurality of plasmas in the discharging space around the inner glass tube. Consequently, it has become possible to obtain a substantially uniform light output distribution over the entire portions of the discharge lamp. In addition, owing to the means for separating and fixing the plurality of discharge channels, the discharge plasmas are stably maintained to prevent the output light from flickering.

It will be seen from the foregoing description that the present invention provides a practical and less expensive single-base fluorescent lamp having a uniform output light distribution over the whole portions of the lamp. Thus, the lamp of the present invention can be used most conveniently for general illuminating or light purposes.

While we have shown and described several embodiments in accordance with the present invention, it is understood that the same is not limited thereto but is susceptible of numerous changes and modifications as known to a person skilled in the art, and we therefore do not wish to be limited to the details shown and described herein but intend to cover all such changes and modifications as are obvious to one of ordinary skill in the art.

We claim:

1. A low pressure metal vapor discharge lamp comprising:

an outer glass envelope defining an enclosed discharge space;

an inner glass tube disposed within said outer glass envelope, said tube being open at one end thereof and closed at the other end thereof;

a single cathode disposed in said inner glass tube;

a plurality of anodes disposed in said outer glass envelope outside said inner glass tube;

circuit means for simultaneously applying the same voltage to all of said anodes at a value above the voltage value of said cathode, said circuit means including ballast means in the form of a single ballast having one end which is commonly connected in series with all of said anodes for effecting self-excitation switching between said anodes so as to form a plurality of discharge plasmas in said discharge space.

2. A discharge lamp according to claim 1 further including means for fixing the locations of the discharge plasmas in said discharge space in order to prevent fluctuating movement thereof.

3. A discharge lamp according to claim 1 wherein all of said anodes are connected together so as to be electrically shorted with each other.

4. A discharge lamp according to claim 1 wherein said other end of said inner glass tube is closed by a wall portion which cooperates with said outer glass envelope to enclose said discharge space.

5. A discharge lamp according to claim 1 wherein said plurality of anodes are positioned adjacent the closed end of said inner glass tube.

6. A discharge lamp according to claim 5 wherein said plurality of anodes are disposed symmetrically around said inner glass tube.

7. A discharge lamp according to claims 1, 4 or 5 wherein said circuit means comprises a pair of power terminals, a full wave rectifier circuit, said single ballast being connected between one of said power terminals and one side of the input of said rectifier circuit, the other power terminal being connected to the other side of the input of said rectifier circuit, one side of the output of said rectifier circuit being connected directly to all of said anodes in common, and a glow lamp connected in series with said single cathode across the output of said rectifier circuit.

8. A discharge lamp according to claim 1 wherein all of said anodes are connected together by a low resistance path of low inductance.

9. A low pressure metal vapor discharge lamp having an outer glass envelope defining a closed discharge space; an inner glass tube disposed within said envelope and having an open end and a closed end; a cathode disposed within said tube; a plurality of anodes disposed within said envelope outside said tube; and circuit means for simultaneously applying voltage to the anodes, said circuit means including ballast means to provide current stabilization and connection means for allowing anode oscillation current to flow between said anodes in response to anode oscillations occurring in each of said anodes, thereby to stably provide a plurality of discharge plasmas in the discharge space.

10. A discharge lamp according to claim 9 characterized in that said connection means is formed by a conductive path of low resistance connecting said anodes directly to each other.

11. A discharge lamp according to claim 9 characterized in that said ballast means comprises a single ballast connected in common to said anodes.

12. A discharge lamp according to claim 9 further including means for fixing the locations of the discharge paths to the respective anodes in order to prevent fluctuating movement of the discharge plasma.

13. A discharge lamp according to claim 9 wherein said closed end of said tube is positioned adjacent the wall of said envelope with the tube extending into said discharge space, said anodes being disposed adjacent the closed end of said tube.

14. A discharge lamp according to claim 13 wherein said anodes are disposed symmetrically about said tube.

15. A discharge lamp according to claims 9 or 14 wherein said connection means comprises a short circuit connection between all of said anodes.

16. A low pressure metal vapor discharge lamp having an outer glass envelope defining a closed discharge space; an inner glass tube disposed within said envelope and having an open end and a closed end; a cathode disposed within said tube; a plurality of anodes disposed within said envelope outside said tube; and circuit means for simultaneously applying the same voltage to all of said anodes, said circuit means including ballast means connected to said anodes to provide current stabilization at said anodes, and means for effecting connection between said anodes to allow an anode oscillation current to flow between the anodes in the discharge space in response to voltage oscillation occurring at each of the anodes, thereby to provide a plurality of stable discharge plasmas in the discharge space.

17. A discharge lamp according to claim 16 wherein the anodes are connected substantially directly to each other substantially without impedance between them, and in that said ballast means is formed by a single ballast connected in common to all the anodes.

18. A discharge lamp according to claim 16 further including means for fixing the locations of the discharge paths to the respective anodes in order to prevent fluctuating movement of the discharge plasmas.

* * * * *